United States Patent [19]

Ulmann et al.

[11] Patent Number: 4,626,973

[45] Date of Patent: Dec. 2, 1986

[54] LAMP JUNCTION, METHOD OF ASSEMBLY THEREOF AND LAMP

[75] Inventors: Philippe Ulmann, Wollerau; Jürg Schmidt, Wald, both of Switzerland

[73] Assignee: Ulmann Holding AG, Wollerau, Switzerland

[21] Appl. No.: 738,393

[22] Filed: May 28, 1985

[30] Foreign Application Priority Data

Jun. 4, 1984 [CH] Switzerland ..... 2711/84

[51] Int. Cl.[4] ..... F21V 19/00

[52] U.S. Cl. ..... 362/277; 362/282; 362/414; 362/419

[58] Field of Search ..... 362/282, 277, 283, 295, 362/303, 304, 414, 419, 284, 345, 275, 373, 362

[56] References Cited

U.S. PATENT DOCUMENTS

| | | | |
|---|---|---|---|
| 1,801,991 | 4/1931 | Andersen | 362/282 |
| 2,446,240 | 8/1948 | Naysmith | 362/282 |
| 2,491,448 | 12/1949 | Hillenbrand et al. | 362/283 |
| 2,850,622 | 9/1958 | Johnson | 362/275 |

FOREIGN PATENT DOCUMENTS

| | | |
|---|---|---|
| 548827 | 4/1932 | Fed. Rep. of Germany . |
| 2618311 | 11/1977 | Fed. Rep. of Germany . |
| 2169953 | 1/1973 | France . |

*Primary Examiner*—James C. Yeung

*Attorney, Agent, or Firm*—Werner W. Kleeman

[57] ABSTRACT

In order to be able to substantially pre-assemble the functional components of a lamp before the components of the lamp which are visible from the exterior, such as lamp shades, lamp support members and so forth are assembled thereto such that the same lamp junction can be employed for different external appearances of lamps, the lamp junction comprises a central support junction upon one or both sides of which a connection member can be mounted. Each such connection member forms a guide for an electrical connection lead and serves to rotatably support an anchorage member for a lamp shade member upon the connection member. After assembling and electrically wiring the central support junction, the connection member, the anchorage member and a lamp socket, the lamp shade member, a cover sleeve for the central support junction and the lamp support member can be subsequently mounted to the lamp junction.

8 Claims, 6 Drawing Figures

LAMP JUNCTION, METHOD OF ASSEMBLY THEREOF AND LAMP

BACKGROUND OF THE INVENTION

The present invention broadly relates to lighting fixtures or lamps and, more specifically, pertains to a new and improved construction of a lamp junction for lamps to be assembled in a variety of external forms and appearances from standard components.

Generally speaking, the lamp junction of the present invention serves for electrically and mechanically connecting at least one lamp or light bulb socket as well as a light shield or lamp shade member surrounding the light bulb or other light source to a lamp support member or standard. A central support junction is provided with a bore for accommodating the lamp support member or standard. At least one substantially tubular connection member for each lamp or light bulb socket is fixedly arranged in the central support junction. An anchorage member for the light shield or lamp shade member which can be slid onto the connection member is axially fixedly but freely rotatably mounted upon the substantially tubular connection member.

In other words, the lamp junction of the present invention is for electrically and mechanically connecting at least one lamp socket and at least one lamp shade member to a lamp support member and comprises a central support junction, at least one substantially tubular connection member for the lamp socket and at least one anchorage member for each shade member. The central support junction is provided with a bore for accommodating the lamp support member. The substantially tubular connection member is fixedly mounted in the central support junction. The anchorage member is constructed to be slid onto the substantially tubular connection member and is axially fixed but freely rotatably mounted thereon.

The method for assembling the inventive lamp junction comprises the steps of assembling the central support junction, the tubular connection member and the anchorage member together and subsequently wiring-up the lamp socket.

The lamp of the present invention comprises the inventive lamp junction and has a cover sleeve formed from a section of substantially tubular material and has the section of substantially tubular material provided with an aperture for accommodating the lamp support member.

Lamp junctions of this general type are known, for instance from the U.S. Pat. Nos. 2,491,448, granted Dec. 13, 1949, and 2,850,622, granted Dec. 2, 1958. These lamp junctions form basic supporting elements of lamps upon which, on the one hand, the lamp or light bulb socket and the light shield or lamp shade member and, on the other hand, the lamp support member or standard are fastened and simultaneously permit the electrical wiring of the lamp or light bulb socket in accordance with safety regulations, which poses problems especially in relation to adjustably arranged light shields or lamp shade members. The body of the lamp must be mechanically stable without substantially increasing the weight of the lamp.

While the known lamp junctions do partially fill these requirements, they only do so by employing a multiplicity of individual components of complicated shape, of which the support components in particular are visible on the exterior and determine the appearance of the lamp. Therefore, the appropriate components must be fabricated and kept in inventory for each lamp type. An alteration of the external appearance of the lamp thus requires a new lamp junction especially adapted thereto.

SUMMARY OF THE INVENTION

Therefore, with the foregoing in mind, it is a primary object of the present invention to provide a new and improved construction of a lamp junction which does not exhibit the aforementioned drawbacks and shortcomings of the prior art constructions.

Another and more specific object of the present invention aims at providing a new and improved construction of a lamp junction of the previously mentioned type which can be assembled from relatively few simple and standardizable individual components and permits the greatest possible variability of the external appearance of the lamp without, however, itself requiring to be adapted to each new appearance, so that the lamp junction can be fabricated and maintained in inventory as a standard element regardless of the individual appearance of each desired lamp, such as color.

Another object of the present invention is to render the final assembly of the components determining the external appearance of the lamp as simple as possible.

Yet a further significant object of the present invention aims at providing a new and improved construction of a lamp junction of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the lamp junction of the present invention is manifested by the features that the central support junction and the anchorage member for the light shield or lamp shade member are constructed as coaxially arranged profile sections of the same or essentially the same profile. The profile sections can be concealed from the exterior by cover sleeves and portions of the light shield or lamp shade member which can be slid onto the profiled sections. This arrangement permits divorcing the lamp junction, which has a basically functional purpose which remains the same for many types of lamp, from the external appearance of the lamp.

In other words, the lamp junction of the present invention is manifested by the features that the central support junction comprises a first profile section, each anchorage member comprises a second profile section, the first profile section and the second profile section each have a substantially identical circumferential profile, and the first and second profile sections are coaxially arranged. At least one cover sleeve is provided for the central support junction and is constructed to slide onto the first profile section for shielding the first profile section from the exterior. The lamp shade member is constructed to at least partially slide onto the second profile section for supporting the lamp shade member and for shielding the second profile section from the exterior.

The method for assembling a lamp junction of the present invention is manifested by the method steps of assembling the lamp shade member, the lamp support member and the cover sleeve to the pre-assembled functional components of the lamp in such manner that the components visible from the exterior are freely installable and exchangeable.

The lamp of the present invention is manifested by the features that essentially only the lamp shade member, the lamp support member, the cover sleeve and the lamp bulb are visible from the exterior.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 2:
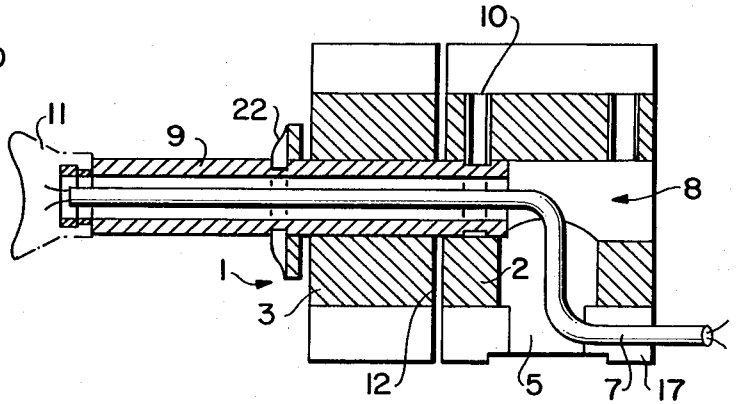
FIG. 2 schematically shows the lamp junction in partially pre-assembled condition.
Figure 1:
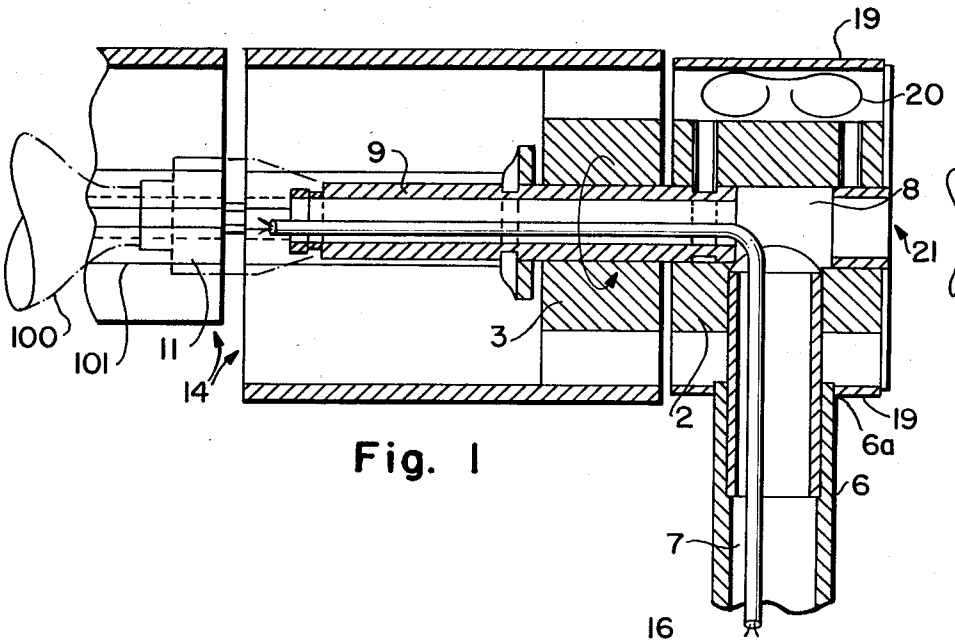
FIG. 1 schematically shows an assembled lamp in the region of its lamp junction in a sectional view.

Describing now the drawings, it is to be understood that to simplify the showing thereof, only enough of the structure of the lamp junction has been illustrated therein as is needed to enable one skilled in the art to readily understand the underlying principles and concepts of this invention. Turning now specifically to FIGS. 1 and 2 of the drawings, the construction illustrated therein by way of example and not limitation will be seen to comprise a lamp junction 1 in pre-assembled condition, as particularly shown in FIG. 2. The essential components of the lamp junction 1 are a central support junction 2 and an anchorage member 3 for a light shield or lamp shade member 14.

Figure 3B:
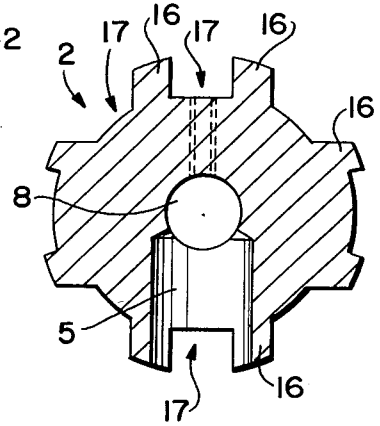
FIG. 3*b* shows the central support junction of the lamp junction in cross-section.
Figure 3A:
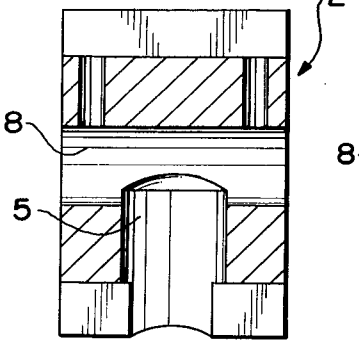
FIG. 3*a* shows the central support junction of the lamp junction in longitudinal section.
Figure 4B:
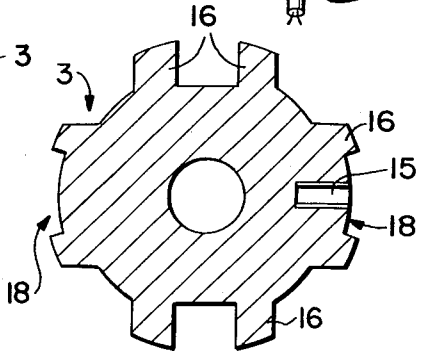
FIG. 4*b* schematically shows the anchorage member of the lamp junction in cross-section.
Figure 4A:
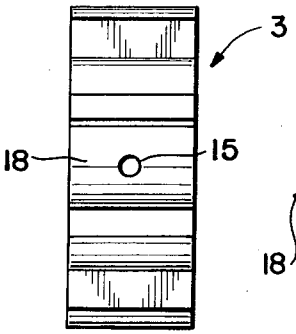
FIG. 4*a* schematically shows the anchorage member of the lamp junction in side view.

The central support junction 2 is shown in more detail in FIGS. 3*a* and 3*b*, while the anchorage member is shown in more detail in FIGS. 4*a* and 4*b*. The central support junction 2 comprises a bore 5 for accommodating a lamp support member or standard 6 (cf. FIG. 1) and for introducing an electrical conductor or connection lead 7. A further open-ended bore 8 extending transversely to the bore 5 serves for accommodating, on one or both sides of the central support junction 2, a respective substantially tubular connection member 9. The connection member 9 is fixedly arrestable in the bore 8 by a screw or threaded member 10. The electrical conductor or connection lead 7 to a schematically represented lamp or light bulb socket 11 is guided within the connection member 9.

The previously mentioned anchorage member 3 can be slid onto the connection member 9 and is rotatably journaled thereupon. For this purpose, the anchorage member 3 is supported by a bearing ring 12 against the central support junction 2 and, on its other side, by an axially elastic snap ring or circlip 22 against the connection member 9. The anchorage member 3 serves to anchor or support the light shield or lamp shade member 14. The light shield or lamp shade member 14 can be slid over the anchorage member 3 from the side thereof confronting the light bulb socket 11 and can be fastened to the anchorage member 3 by screws inserted into the appropriate threaded holes 15. The light shield or lamp shade member 14 is therefore, conjointly with the anchorage member 3, freely rotatable about the connection member 9. The connection member 9, conjointly with the light bulb socket 11 and the central support junction 2, remains stationary and therefore induces no torsion in the electrical connection lead 7.

The central support junction 2 and the anchorage member 3 are constructed as profile sections cut from the same profile, as can be appreciated from FIGS. 3*a*, 3*b*, 4*a* and 4*b*. They are preferably sections cut from a drawn or extruded aluminum profile of appropriate cross-section and are subsequently provided with appropriate bores 8. The profile comprises longitudinal ribs 16 with channels 17 disposed therebetween, which arrangement permits a circulation of air along the ribs 16 and thereby reduces the heating-up of the externally touchable lamp components in particular. Lateral guide channels or recesses 18 are provided instead of the channels 17. The channels or recesses 18, which are shown to possess a lesser depth than the channels 17, are provided on the anchorage member 3 for accommodating corresponding protrusions 101 on the light shield or lamp shade member 14. The longitudinal ribs 16 are formed on the periphery of the anchorage member 3 and on the periphery of the central support junction 2 such that they are inscribable in, or circumscribed by, a circle so that the substantially tubular continuation or extension of the light shield or lamp shade member 14 can be slid over the anchorage member 3 and a substantially tubular cover sleeve 19 can be slid over the central support junction 2 and both can be supported by the associated longitudinal ribs 16.

The described arrangement is designed such that the lamp junction 1 can be mechanically and electrically pre-assembled, for instance as indicated in FIG. 2, and such that the components visible on the exterior, such as the light shield or lamp shade member 14, the cover sleeve 19, the lamp support member or standard 6 and the light bulb 100 installed in the lamp or light bulb socket 11 can be subsequently assembled thereto or installed (cf. FIG. 1). There thus persists complete freedom relative to the selection of color and other outwardly visible characteristics of the lamp up until the simply performable final lamp assembly, so that the lamp junction 1 can be pre-fabricated regardless of the particular external design, and the final assembly can be performed in situ in accordance with the wishes of the purchaser.

The final lamp assembly can be performed in the following manner:

First the cover sleeve 19, which is ultimately secured by a spring 20, is slid over the central support junction 2. Since, however, the electrical conductors or connection lead 7 has already been previously installed, the electrical connection lead 7 must first be inserted into the cover sleeve 19 and through its aperture 6*a* for the lamp support member 6. For sliding the cover sleeve 19 onto the central support junction 2, the electrical connection lead 7 is temporarily inserted into the lowermost of the channels 17 as seen in FIG. 3*b*.

Once the cover sleeve 19 has been slid onto the central support junction 2, the electrical connection lead 7 then can be inserted into the lamp support member 6 and the lamp support member 6 fastened to the central support junction 2. Subsequently, the lamp shield or lamp shade member 14 must be slid over the anchorage member 3 and fixed thereto. If only one lamp is envisioned, as indicated in FIG. 1, a cover plate or closure 21 can be arranged on the opposite side of the central support junction 2.

The lamp junction 1 described can be pre-assembled in the form shown in FIG. 2, whereafter final assembly requires, as previously mentioned, only a few manual operations. In particular, the electrical connection lead 7 can already be wired up before final assembly, which is advantageous for reasons of safety. The light shield or lamp shade member 14 is also freely rotatable without influencing the electrical connection lead 7.

A modular or construction kit-like system can thus be realized in which lamps of differing design can be assembled in simple manner from the described lamp junction components, for instance, in a single bulb version (cf. FIG. 1) or double bulb version or with different lamp support members for floor lamps, table lamps or ceiling lamps or with different lamp shade members and in different colors. It is a basic principle of the invention that the same lamp junctions of this type can be employed and pre-assembled for all such lamp versions. A considerably increased variability of the external appearance can thus be achieved while retaining the same functional construction.

While there are shown and described present preferred embodiments of the invention, it is to be distinctly understood that the invention is not limited thereto, but may be otherwise variously embodied and practiced within the scope of the following claims.

Accordingly, what we claim is:

1. A lamp junction for electrically and mechanically connecting at least one lamp socket and at least one lamp shade member to a lamp support member, comprising:

a central support junction;

said central support junction being provided with a bore for accommodating the lamp support member;

at least one substantially tubular connection member for the at least one lamp socket;

said at least one substantially tubular connection member being fixedly mounted in said central support junction;

at least one anchorage member for each at least one lamp shade member;

said at least one anchorage member being constructed to slide onto said at least one substantially tubular connection member and being axially fixed but freely rotatably mounted thereon;

said central support junction comprising a first profile section;

each said at least one anchorage member comprising a second profile section;

said first profile section and said second profile section each having a substantially identical circumferential profile;

said first and second profile sections being coaxially arranged;

at least one cover sleeve for said central support junction;

said at least one cover sleeve being constructed to slide onto said first profile section for shielding said first profile section from the exterior;

the at least one lamp shade member being constructed to at least partially slide onto said second profile section for supporting the at least one lamp shade member and for shielding said second profile section from the exterior;

said circumferential profile of each said first and second profile sections comprising longitudinal ribs and longitudinal channels disposed between said longitudinal ribs;

said longitudinal ribs each comprising an outer peripheral portion;

said longitudinal ribs being configured at said outer peripheral portions thereof such that said circumferential profile of each of said first and second profile sections is essentially circumscribed by a circle; and said longitudinal channels enabling air circulation along said longitudinal ribs.

2. The lamp junction as defined in claim 1, wherein:

said first and second profile sections comprise sections of an extruded aluminum profile.

3. The lamp junction as defined in claim 1, wherein:

the at least one lamp shade member is constructed to at least partially slide onto said second profile section by substantially tubularly surrounding said second profile section; and means for removably fastening the at least one lamp shade member to said second profile section.

4. The lamp junction as defined in claim 1, wherein:

said at least one cover sleeve comprises a section of substantially tubular material; and said section of substantially tubular material comprises an aperture for accommodating the lamp support member.

5. The lamp junction as defined in claim 1, further including:

an electrical connection lead;

said bore in said central support junction defining a region;

one longitudinal channel of said longitudinal channels being arranged at said region; and said one longitudinal channel having a cross-section for temporarily accommodating said electrical connection lead while said at least one cover sleeve is being slid onto said first profile section.

6. A lamp junction for electrically and mechanically connecting at least one lamp socket and at least one lamp shade member to a lamp support member, comprising:

a central support junction;

said central support junction being provided with a bore for accommodating the lamp support member;

at least one substantially tubular connection member for the at least one lamp socket;

said at least one substantially tubular connection member being fixedly mounted in said central support junction;

at least one anchorage member for each at least one lamp shade member;

said at least one anchorage member being constructed to slide onto said at least one substantially tubular connection member and being axially fixed but freely rotatably mounted thereon;

said central support junction comprising a first profile section;

each of said at least one anchorage member comprising a second profile section;

said first profile section and said second profile section each having a substantially identical circumferential profile;

said first and second profile sections being coaxially arranged;

at least one cover sleeve for said central support junction;

said at least one cover sleeve being constructed to slide onto said first profile section for shielding said first profile section from the exterior;

the at least one lamp shade member being constructed to at least partially slide onto said second profile section for supporting the at least one lamp shade member and for shielding said second profile section from the exterior;

said central support junction has a first side and a second side;

said at least one substantially tubular connection member comprising a first connection member and a second connection member;

said first connection member being arranged at said first side;

said second connection member being arranged at said second side;

said at least one anchorage member comprising a first anchorage member and a second anchorage member;

said first anchorage member being arranged at said first side; and said second anchorage member being arranged at said second side.

7. A method for assembling a lamp junction for electrically and mechanically connecting at least one lamp socket and at least one lamp shade member to a lamp support member, the lamp junction comprising a central support junction provided with a bore for accommodating the lamp support member, at least one substantially tubular connection member for the at least one lamp socket and fixedly mounted in the central support junction, at least one anchorage member for each at least one lamp shade member and constructed to slide onto the at least one substantially tubular connection member and being axially fixed but freely rotatable thereon, and a cover sleeve for the central support junction, the method comprising the steps of:

assembling said at least one substantially tubular connection member to said central support junction;

assembling said at least one anchorage member to said at least one substantially tubular connection member and said central support junction to form a lamp sub-assembly;

wiring-up said at least one lamp socket;

assembling said at least one lamp socket to said lamp sub-assembly;

subsequently assembling (i) said cover sleeve to said central support junction, (ii) said lamp support member to said central support junction, and (iii) said at least one lamp shade member to said at least one anchorage member; and performing said last-mentioned step of subsequent assembly such that said at least one lamp shade member, said lamp support member and said cover sleeve are freely installable and exchangeable.

8. A lamp, comprising:

a lamp support member;

a lamp junction mounted on said lamp support member;

said lamp junction comprising a central support junction, at least one substantially tubular connection member fixedly mounted in said central support junction and at least one anchorage member constructed to slide onto said at least one substantially tubular connected member and axially fixed but freely rotatably mounted thereon;

said central support junction comprising a first profile section;

said at least one anchorage member comprising a second profile section;

said first profile section and said second profile section each having a substantially identical circumferential profile;

said first profile section and said second profile section being substantially coaxially arranged;

at least one lamp socket mounted on said at least one substantially tubular connection member;

at least one lamp shade member constructed to at least partially slide onto said at least one anchorage member for supporting said at least one lamp shade member and mounted on said at least one anchorage member;

at least one cover sleeve constructed to slide onto said central support junction and mounted on said central support junction;

a lamp bulb inserted into said at least one lamp socket;

said at least one lamp shade member shielding said at least one anchorage member from the exterior and said at least one cover sleeve shielding said central support junction from the exterior such that essentially only said at least one lamp shade member, said lamp support member, said at least one cover sleeve and said lamp bulb are visible from the exterior;

said circumferential profile of each said first and second profile sections comprising longitudinal ribs and longitudinal channels disposed between said longitudinal ribs;

said longitudinal ribs each comprising an outer peripheral portion;

said longitudinal ribs being configured at said outer peripheral portions thereof such that said circumferential profile of each of said first and second profile sections is essentially circumscribed by a circle; and said longitudinal channels enabling air circulation along said longitudinal ribs.

* * * * *